United States Patent [19]

Lambert, III

[11] 3,957,332

[45] May 18, 1976

[54] ELECTRIC CONNECTOR APPARATUS AND METHOD

[75] Inventor: George L. Lambert, III, Lilburn, Ga.

[73] Assignee: Kearney-National, Inc., Atlanta, Ga.

[22] Filed: May 2, 1975

[21] Appl. No.: 574,018

[52] U.S. Cl. ..... 339/12 R; 339/111

[51] Int. Cl.[2] ..... H01R 11/30

[58] Field of Search ..... 339/12 R, 74 R, 111

[56] References Cited

UNITED STATES PATENTS

| | | | |
|---|---|---|---|
| 3,170,752 | 2/1965 | Van Horssen | 339/74 R X |
| 3,493,917 | 2/1970 | Glowacz | 339/74 R |
| 3,569,903 | 3/1971 | Brishka | 339/74 R |
| 3,670,287 | 6/1972 | Keto | 339/12 R |

*Primary Examiner*—Roy Lake
*Assistant Examiner*—DeWalden W. Jones
*Attorney, Agent, or Firm*—Walter M. Rodgers; Walter A. Rodgers

[57] ABSTRACT

An electric terminal bushing having a hollow tubular contact engageable with the contact pin of an electric elbow type connector is arranged so as substantially to reduce the arcing time during a switch closing operation and includes means for slidably mounting the hollow tubular contact within the bushing, magnetic means connected in series with the contact for imparting sliding closing movement thereto in response to the striking of an electric arc between the contact pin and the tubular hollow contact, and latch means mounted on said hollow tubular contact for engaging a part of the bushing so as to hold said tubular contact in its circuit closed position following movement of said contacts to their closed circuit positions.

19 Claims, 7 Drawing Figures

ELECTRIC CONNECTOR APPARATUS AND METHOD

Gas generated by an electric arc within the bushing structure of an electric terminal bushing may be very harmful because the pressure built up during high current fault conditions may be sufficient to damage severely or even destroy the bushing. Furthermore if an operator imparts a low velocity closing movement to the movable connector, the time elapsed while the arc exists may be sufficient to damage severely the conducting elements of the contact structure and a substantial quantity of gas may be produced which may tend to impede the closing operation and may also damage the bushing. Bushings which have been called upon to perform a substantial number of switch opening and closing operations may accumulate carbon deposits which effectively increase the distance between the contacts at which an arc initially strikes. Under these conditions arcing time is prolonged and the attendant production of gas is increased.

According to United States Pat. application Ser. No. 509,959 filed Sept. 27, 1974, the duration of an electric arc during switch closing operations is substantially reduced by the provision of magnetic means connected in series with a contact movably mounted within a bushing and arranged so as to impart switch closing sliding movement to the bushing contact which drives the contact toward the cooperating contact pin when an electric arc strikes between the tubular bushing contact and the contact pin.

In order to make certain that severe overload or fault conditions do not cause the magnetic means of United States Pat. application Ser. No. 509,959 to drive the contacts out of their normal closed circuit condition and in accordance with one form of this invention, latch means is movably mounted on and bodily movable with the hollow tubular contact within the bushing support structure and is arranged for actuation to its latching position in coordination with switch closing movement of a cooperating contact pin. After the tubular slidably mounted contact and the contact pin reach their normal circuit closed positions the latch means is maintained in its latching condition due to engagement of a part thereof with a part of the contact pin.

For a better understanding of the invention reference may be had to the following detailed description taken in conjunction with the accompanying drawings in which FIG. 1 is a cross-sectional view of a terminal bushing constructed according to one form of the invention and of an associated elbow type connector shown partially in section and spaced from the bushing to show an open circuit condition;

Figure 1:
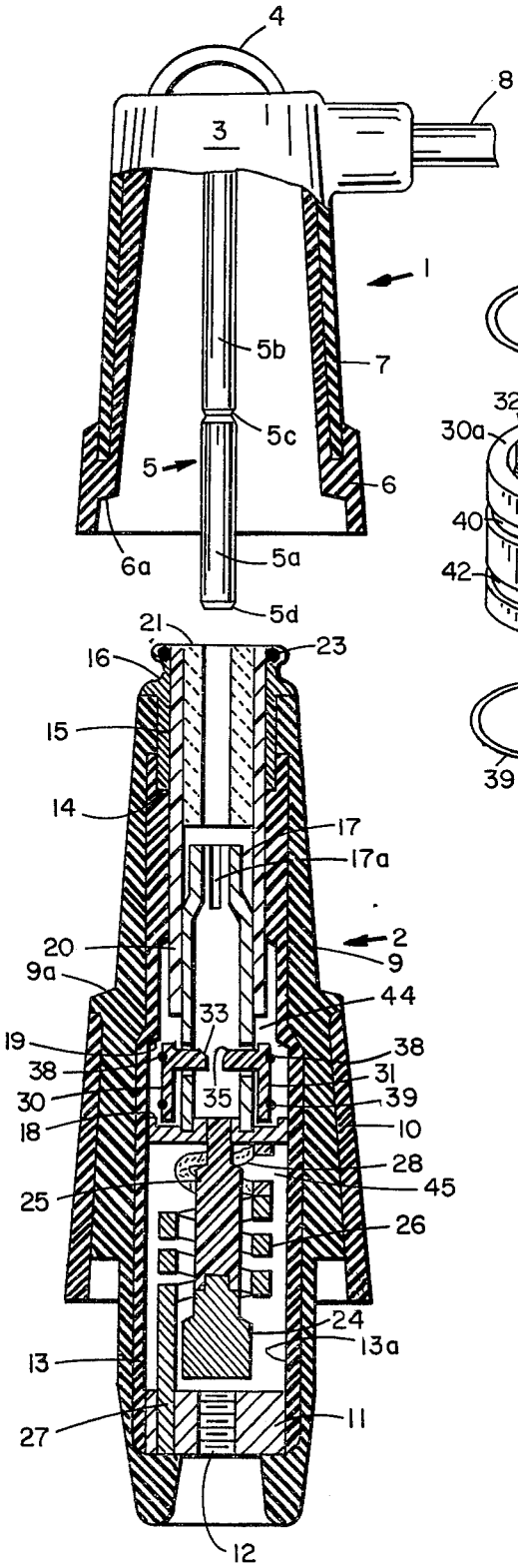
FIG. 1A is an exploded perspective view of a portion of the structure of FIG. 1.
FIG. 1B is a view from above of a latch element formed according to the invention.

With reference to the drawings, the numeral 1 generally designates an elbow type connector arranged to cooperate with a bushing terminal generally designated by the numeral 2. As is well known, the bushing 2 constitutes an exterior terminal for electric apparatus such as a transformer (not shown).

Electric connector 1 is of conventional construction and comprises housing structure 3 to which is affixed a loop 4 and within which is disposed a contact pin 5 having an end portion **5*a* constructed of insulating material and a conducting portion 5*b*. Housing 3 ordinarily includes an insulating structure 6 together with a semi-conductive structure 7. Preferably housing structures 6 and 7 are formed of elastomeric material. Insulated conductor 8 is connected with contact pin 5 within housing 3.**

Terminal bushing 2 comprises a hollow elongated support structure in the form of elastomeric sleeve 9 formed of insulating material together with elastomeric material 10 formed of semi-conducting material in known manner. Disposed within the housing structure 9,10 is a conducting element 11 having an internally threaded aperture 12 for receiving an externally threaded conducting element (not shown) but which forms a part of a transformer winding, for example. A metallic sleeve 13 is secured to and envelopes the electric conductor 11 and extends upwardly toward the upper end of the bushing 2. Sleeve 13 is lined with an insulating layer **13*a* for a portion of its length and is provided with a shoulder 14 which engages the lower end of a cylindrical sleeve 15 having an outwardly projecting flange 16. Sleeve 13 could be formed of non-conducting material and the layer 13*a* could be eliminated. Sleeve 15 and its flange 16 are preferably formed of mechanically strong plastic material and the sleeve and its flange are fixed in position relative to the housing 9 of elastomeric material and to the sleeve 13.**

The hollow tubular electric contact 17 having its upper end slotted as shown at **17*a*, is slidably mounted within sleeve 13 for longitudinal movement and is driven upwardly into engagement with the conducting pin 5*b* immediately following the striking of an arc between the conducting contact pin 5*b* and the contact 17. Toward this end contact 17 is provided with an outwardly projecting shoulder or flange 18 which engages the inwardly projecting shoulder 19 formed in the fixed sleeve 13 which shoulder also constitutes a latching surface according to one facet of this invention. In this way the upper limit of travel of contact 17 is determined. A plastic insulating sleeve 20 is secured to and movable with the contact 17.**

For the purpose of aiding in the extinguishment of electric arcs drawn between the contact **5*b* and the tubular hollow contact 17, a quench tube 21 is fixedly mounted by any suitable means within the upper end of plastic sleeve 20. Quench tube 21 is formed of arc extinguishing material and is securely affixed within the upper end of plastic sleeve 20 so that the structure including sleeve 20, contact 17 and quench 21 is vertically reciprocable within the bushing 2 between the lower position shown in FIG. 1 and an upper position as represented, for example, in FIG. 3. In order to secure plastic tube 20 securely about contact 17, a plurality of grooves 22 may be formed in the outer surface of contact 17 as shown in FIG. 1A. Ring 23 provides a gas seal maintaining insulation integrity along the outside of sleeve 20.**

For the purpose of imparting upward movement to the contact 17 and associated plastic sleeve 20 and tube 21, magnetic means is provided and may comprise a steel armature 24 secured to an insulating link 25 connected to the bottom end of contact 17 via flange or shoulder bar 18 an together with an electromagnetic coil 26 which at its lower end is interconnected with conductor 11 through conductor 27 and which at its upper end is connected with contact 17 through flexible conductor 28 secured to element 18. Insulating liner 13*a* isolates coil 26 and associated conductors from metallic tube 13. Conductor 27 is a rigid structure as is the coil 26 so that in effect the coil is fixed in position relative to conductor 11. Since the armature 24 is affixed to the contact 17 via insulating link 25 and element 18, contact 17 is driven upwardly when the coil 26 is appropriately energized. Such movement is accommodated by the flexible conductor 28.

Figure 1A:
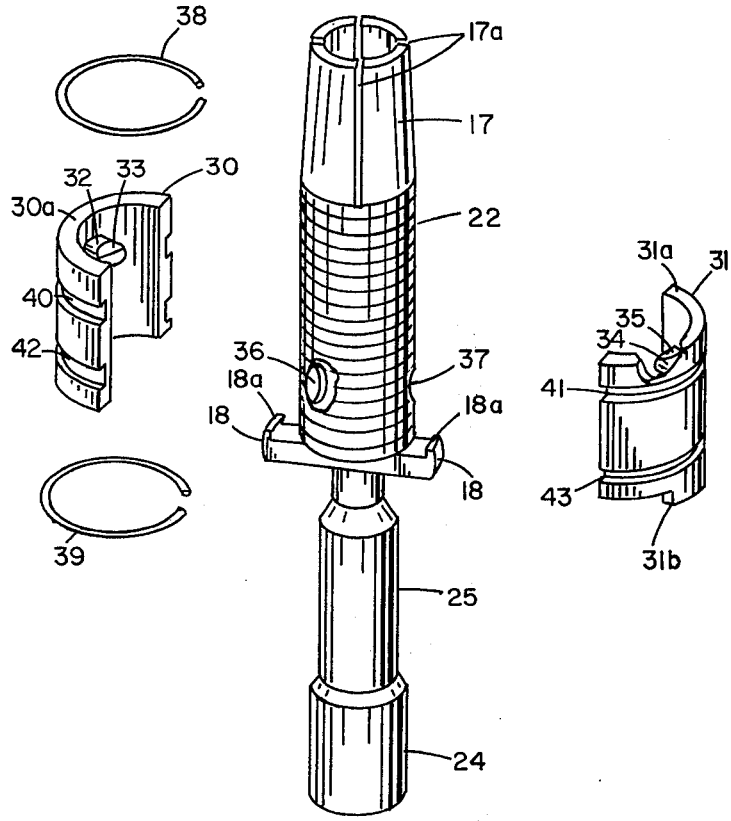
Figure 1B:
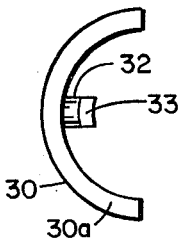
Figure 2:
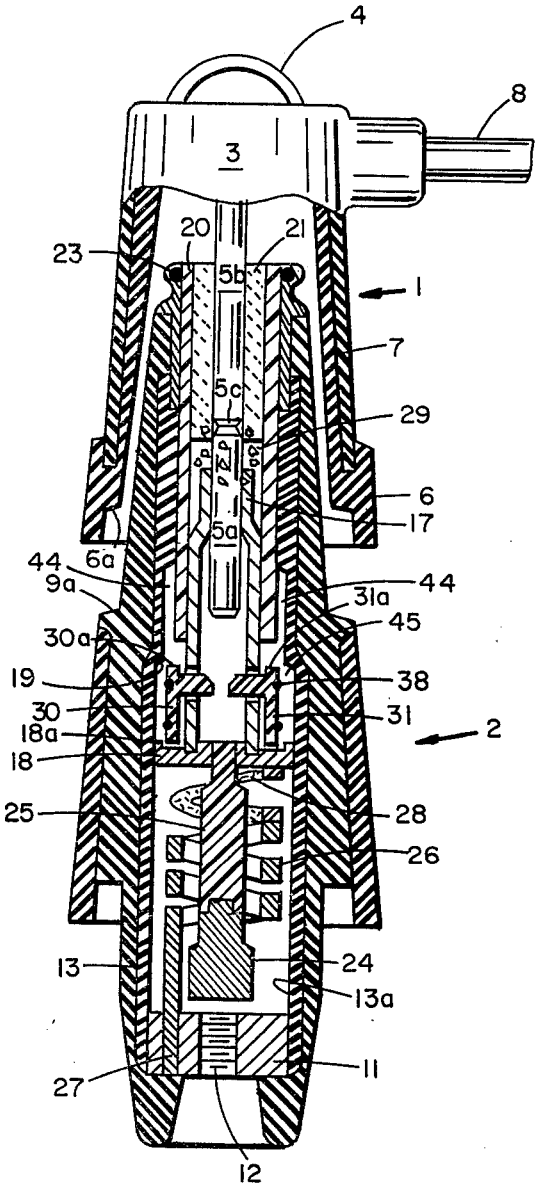
FIG. 2 is a view similar to FIG. 1 but shows the parts in the position which they occupy during a closing operation at the instant when an electric arc is initiated between the contacts.

In order to effect a contact closing operation, the connector 1 is lowered from the position shown for example in FIG. 1 toward the bushing 2. An initial stage of closing is depicted in FIG. 2. In this figure the lower end 5*c* of the conducting portion 5*b* of the contact pin 5 is adjacent to the upper end of contact 17. In FIG. 2 an arc represented at 29 has been established which in turn establishes a flow of current through the flexible conductor 28, the fixed coil 27, the conductor 11, and the winding of the associated transformer. This flow of current imparts an upward force to the steel armature 24 and in turn to the contact 17, the tube 20, and the snuffer 21.

Figure 3:
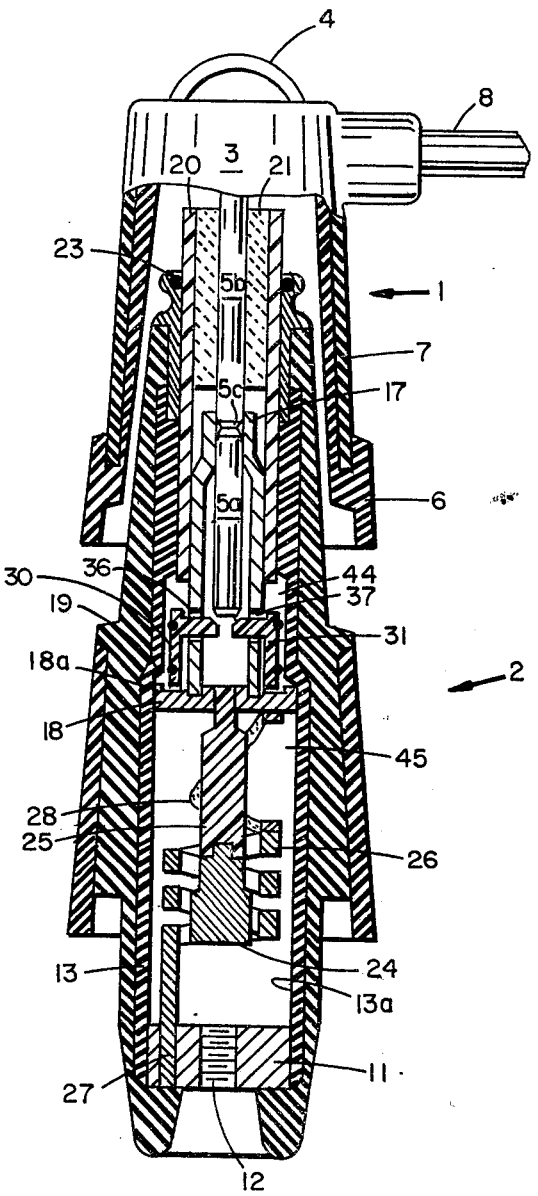
FIG. 3 depicts the parts in the interim positions which they occupy immediately following movement of the bushing contact toward the connector contact pin to establish direct engagement therewith during a contact closing operation.

FIG. 3 depicts the contact 17 in its upper or interim position due to the action of the magnetic means comprising armature 24 and fixed coil 27, the upper limit of travel being determined by engagement of flange or shoulder 18 on the contact 17 with the shoulder 19 forming a part of metallic sleeve 13. Of course flexible conductor 28 extends and allows the metallic armature 24 to move upwardly from its lower position depicted in FIGS. 1 and 2 to the upper position shown in FIG. 3. This movement through the agency of insulating link 25 drives the contact 17 into enveloping relationship with respect to the lower end 5*c* of the conducting part 5*b* of the contact pin 5, the lower portion of the contact pin 5, designated 5*a*, being disposed within the tubular contact 17. In this condition the contacts 5*b* and 17 are closed and the arc extinguished.

The quick upward travel of the contact 17 from the position shown in FIG. 2 when the arc 29 is initially established to the upper or interim position represented in FIG. 3 which is spaced longitudinally from the normal position substantially reduces the duration of the arc and in turn substantially limits the formation of gas within the support structure comprising the bushing 2. By this means internal pressures are limited and effectively controlled and damage to the bushing 2 substantially minimized or eliminated. Furthermore since the arcing time is substantially reduced, the deleterious effects of arcing between the contacts 5*b* and 17 are minimized. The contacts mate prior to engagement by follower 5*a* of the latch formed according to this invention.

Figure 4:
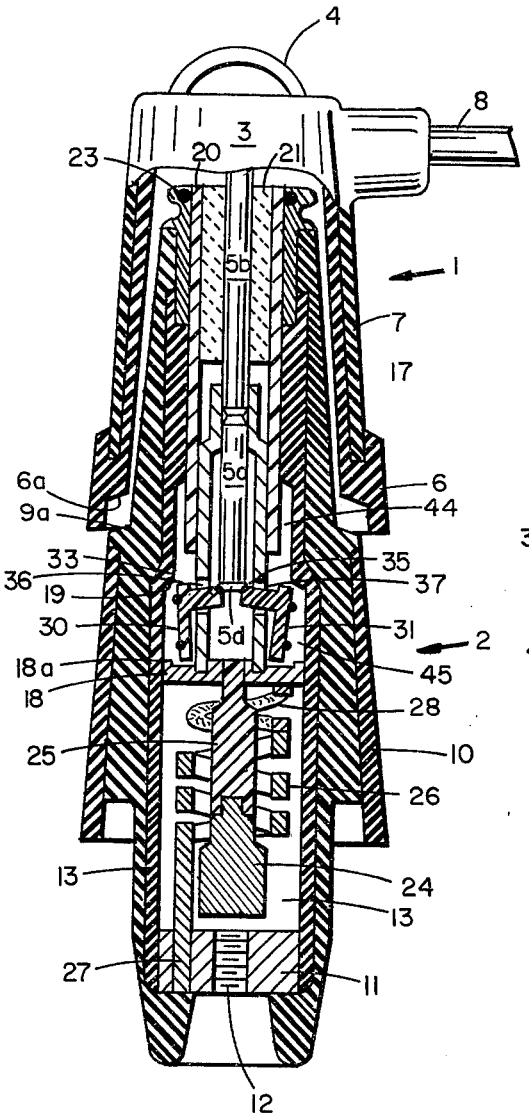
FIG. 4 shows the parts in the positions which they occupy at the instant of initial contact between the contact pin and a part of the latch means and before a latching operation is completed.

FIG. 4 shows the contacts 5*b* and 17 substantially closed. This figure however depicts the housing structure 6 and 7 in the positions which these parts occupy just prior to a fully closed condition. Thus with the parts in the positions represented by FIG. 4, the elbow connector 1 is lowered until the surface 6*a* of the housing 6 engages the surface 9*a* of the bushing housing insulating material 9. When these surfaces come into cooperative engagement, the parts occupy the normal positions depicted in FIG. 5 and the circuit is completely closed.

In order to separate the contacts, the elbow connector 1 is simply elevated. After the latch is disengaged, the frictional relationship between contact pin 5 and hollow contact 17 causes contact 17 to move upwardly when connector 1 is lifted. Toward this end a hook stick or other suitable manipulative apparatus is engaged with the operating hook 4 and an upward force exerted thereon to cause the connector 1 to move from the position depicted in FIG. 5 to an intermediate position such as is depicted in FIG. 3. In FIG. 3 the flange or shoulder 18 formed at the bottom of the contact 17 is shown engaging the internal shoulder 19 formed in fixed tube 13, and upward movement of contact 17 and parts associated therewith is suddenly arrested. This sudden stoppage of upward movement of the contact 17 imparts a snap action opening operation whereby the lower end 5*c* of the conducting part 5*b* of contact pin 5 is quickly separated from the upper end of hollow contact 17 and the arc drawn between these contacts is effectively and quickly extinguished by the known action of the insulating part 5*a* of the contact pin 5 in cooperation with the quench tube 21. Continued upward movement of elbow connector 1 results in a complete separation of elbow 1 and bushing 2 to cause the parts to occupy open circuit positions analagous to those represented in FIG. 1.

Figure 5:
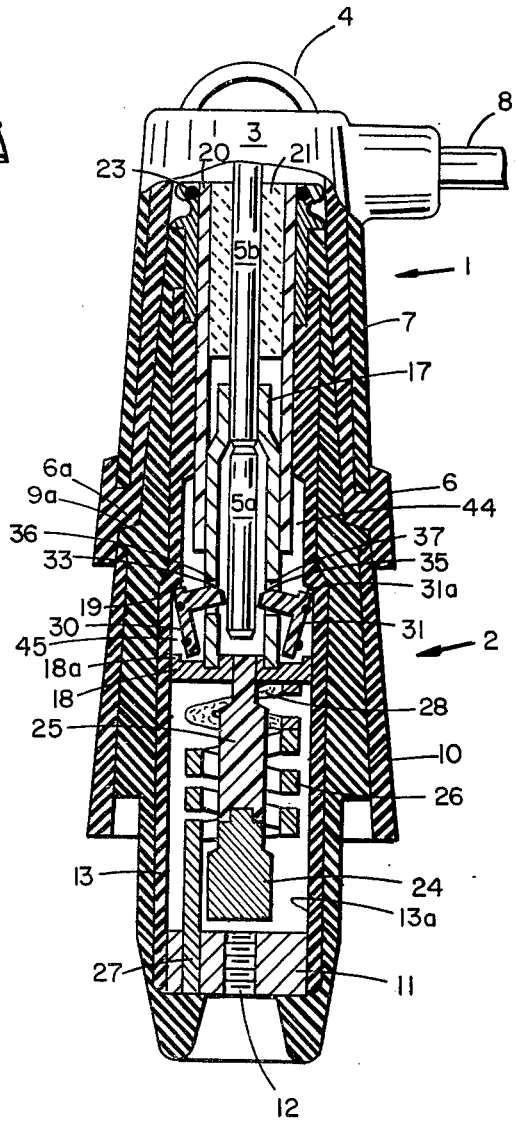
FIG. 5 shows the contacts in their normal fully closed positions and with the elbow connector in its closed position relative to the bushing in which position the contact pin holds the latch means of this invention in its latching condition.

With the parts occupying the closed circuit or normal positions as shown in FIG. 5, it is possible that a severe overload or fault condition could develop and such condition would tend to activate the magnetic means comprising the coil 26 and its metallic armature 24 and unless appropriate provision is made to prevent it, the slidable structure would tend to move upwardly toward the position represented by FIG. 3. Such action could conceivably be of such force as to cause the elbow to disengage the bushing and cause the parts to occupy positions somewhat analagous to the positions depicted in FIG. 3 causing loss of water seal and electrical integrity which could result in damage to the bushing or to the elbow connector. Such damage conceivably could be quite violent in nature.

In order to preclude such an event, latch means is provided according to this invention. As best shown in FIG. 1A, this latch means comprises a plurality of latch elements designated by the numerals 30 and 31. Latch element 30 includes an inwardly projecting latching finger designated by the numeral 32. The inner end of latching finger 32 is bevelled as indicated at 33. This bevelled arrangement is in a direction which is generally longitudinal with respect to the bushing 2 and of course contact 17. A similar latching finger 34 is provided on the arcuate latch element 31 and is observable in FIG. 1A because latch element 31 is partially broken away in FIG. 1A. Latching finger 34 is provided with a bevelled surface 35. As is apparent particularly in FIGS. 1–5, bevelled surfaces 33 and 35 are disposed in an upwardly diverging relation to each other so that downward movement of the end 5*d* of insulating part 5*a* of contact pin 5 is guided in such manner as to impart outward movement to latch elements 31 and 32 relative to hollow tubular contact 17. It is apparent particularly from FIG. 1A that the arcuate configuration of the inner surfaces of latch elements 31 and 32 is complementary to and conforms generally with the configuration of the outer surface of tubular contact 17. Furthermore tubular contact 17 is provided with a pair of transverse apertures 36 and 37 which respectively receive the latching fingers 32 and 34. Contact 17 is broken away to show aperture 36 from the inside in FIG. 1A. Latch elements 30 and 31 are enveloped by a pair of circular biasing springs designated by the numerals 38 and 39 which are received respectively within grooves 40,41 and 42,43 formed in latch elements 30 and 31 so that the latch elements 30 and 31 are normally held in snug engagement with the tubular hollow contact 17 by springs 38 and 39. As is apparent in FIGS. 1 and 1A groove 40,41 and the associated spring 38 are disposed in substantial coincidence with the latch fingers 32 and 34.

In order to perform an appropriate latching function whereby tubular contact 17 is held in its normal position as shown for example in FIG. 1, the latching elements 30 and 31 must tilt outwardly so that the upper edges such as 30*a* and 31*a* of latch elements 30 and 31 respectively are caused to engage the latching surface 19. It is necessary to preserve an operable relationship between the latch elements 30 and 31 and the movable structure comprising hollow tubular contact 17 and its associated shoulder bar or flange 18. Toward this end a pair of upwardly extending latch engaging projections 18*a* are formed on bar 18. Thus the lower projections such as that indicated at 31*b* on latch element 31 may rest between a projection such as 18*a* and the exterior surface of hollow tubular contact 17. The projection 18*a* which is upwardly extending and the downwardly extending latching projection 31*b* constitute a pivot about which the latch element 31 may pivot outwardly due to the outward force exerted on latch finger 34 by the lower part 5*a* of contact pin 5 during a circuit closing operation. Latch element 30 operates in a similar fashion.

FIG. 2 depicts an instant during a closing operation at which the lower end 5*c* of the conducting part 5*b* of contact pin 5 is adjacent the upper end of tubular contact 17, the spacing being such that an arc 29 is established.

Establishment of the arc as indicated at 29 in FIG. 2 tends to activate the magnetic means comprising armature 24 and coil 26 and to drive the movable parts which are shown in exploded condition in FIG. 1A to their upper or interim positions as shown in FIG. 3. This action facilitates contact closing and reduces arcing time and the deleterious effects that accompany prolonged arcing according to the above mentioned United States Pat. application Ser. No. 509,959.

In order to accommodate this action and to provide clearance space for the latch means comprising latch elements 30 and 31, their springs 38 and 39 and associated structure, the bushing contact support means is provided with a latch receiving cavity designated by the numeral 44 so that the latch means may proceed upwardly to the position depicted in FIG. 3 without interfering with the rapid contact closing action of United States Pat. application Ser. No. 509,959.

With the contacts closed as represented in FIG. 3, the parts are moved toward fully closed condition and during such closing movement, the lower end 5*d* of insulating part 5*a* of the contact pin 5 engages the bevelled surfaces 33 and 35 of the latching fingers 32 and 34 to mitiate outward swinging movement of latch elements 30 and 31 about the upwardly extending latch engaging projections 18*a* and the downwardly extending projections such as 31*b* and a similar projection on latch element 30 which is not shown in the drawings. Thus latch element 30 as viewed in the drawings swings in a counterclockwise direction about the left hand latch engaging projection 18*a* while latch element 31 swings in a clockwise direction about the right hand latch engaging upwardly extending projection 18*a* to occupy the positions depicted in FIG. 5. When so disposed as shown in FIG. 5, the upper parts 30*a* and 31*a* of latch elements 30 and 31 respectively are in abutting engagement with the latching surface 19. When in this condition any severe overload or fault condition cannot impart upward movement to hollow tubular contact 17 and parts associated therewith even though the magnetic means comprising coil 26 and armature 24 might exert a substantial upward force thereon. It is apparent that for some applications of the invention only one latch element might be needed and that in other instances more than two latch elements could be employed.

It is apparent from the drawings that the metallic tube 13 is configured so as to define a latching cavity 45 which is configured to accommodate transverse swinging movement of said latch elements and which is immediately below the latch receiving cavity 44 and which is disposed in coaxial relationship therewith. It is also apparent that the latching surface 19 is disposed between the latch receiving cavity 44 and the latching cavity 45.

From the above description it is apparent that by this invention latch means is provided with renders the magnetic closing means ineffective to impart movement to a contact slidably mounted within a support structure from a normal or circuit closed position as represented in FIG. 5 toward an interim or open circuit condition and that such action is accomplished without impairing in any way the normal and proper function of the magnetic rapid contact closing means formed according to United States Pat. Ser. No. 509,959.

The embodiments of the invention in which an exclusive property or privilege is claimed are defined as follows:

1. Electric connector apparatus comprising hollow elongated support structure, a tubular electric contact mounted within said support structure and movable longitudinally relative thereto between a normal closed circuit position and an interim position, said interim position being spaced longitudinally from said normal position, a contact pin movable independently of said support structure for engaging and disengaging said tubular contact, and latch means movable with said contact and engageable with a part of said support structure for preventing substantial movement of said contact from its normal position toward its interim position, said latch means being activated by movement of said contact pin relative to said tubular contact.

2. Electric connector apparatus comprising hollow elongated support structure, a tubular electric contact mounted within said support structure and movable longitudinally relative thereto between a normal closed circuit position and an interim position, said interim position being spaced longitudinally from said normal position, a contact pin movable independently of said support structure and engageable and disengageable with said tubular contact, and latch means engageable with a part of said support structure in coordination with circuit closing movement of said contact pin for securing said tubular contact in its normal position.

3. Electric apparatus according to claim 2 wherein said latch means includes a part which is engaged by a part of said other contact to latch said one contact in its normal position during a closed circuit condition.

4. Electric apparatus according to claim 2 wherein said latch means comprises a latch element movably mounted on said one contact and wherein biasing means is arranged to urge said latch element toward said one contact.

5. Electric apparatus according to claim 2 wherein said latch element is of arcuate configuration and is complementary in shape to the exterior of said tubular contact.

6. Electric apparatus according to claim 2 wherein said latch means comprises a plurality of complementary latch elements disposed about said tubular contact and at least one generally circular spring disposed about said elements and arranged to bias said latch elements toward one contact.

7. Electric apparatus according to claim 2 wherein said latch means is mounted on and movable with said tubular contact and wherein said support structure includes a latching cavity in which said latch means is disposed when in condition to perform a latching operation.

8. Electric apparatus according to claim 7 wherein said latching cavity is configured to accommodate transverse movement of said latch means.

9. Electric apparatus according to claim 2 wherein said latch means is mounted on and movable with said tubular contact and wherein said support structure includes a latch receiving cavity in which said latch means is disposed when said contact is in its interim position.

10. Electric apparatus according to claim 2 wherein said support structure includes coaxial latching and latch receiving cavities and a latching surface therebetween for engaging said latch means whereby movement of said tubular contact from its normal position to its interim position is prevented.

11. Electric connector apparatus comprising support structure, a pair of relatively movable contacts one of which is mounted on said support structure and movable between normal and interim positions and the other of which is movable independently of said support structure, and latch means operably related with said one contact and engageable with a part of said support structure for preventing substantial movement of said one contact from its normal position toward its interim position, said latch means including a latch element pivotally mounted on said one contact.

12. Electric apparatus according to claim 11 wherein said one contact includes a flange having a latch engaging projection thereon for engaging a part of said latch element whereby said latch element is mounted for pivotal movement relative to said one contact.

13. Electric connector apparatus comprising support structure, a pair of relatively movable contacts one of which is of hollow tubular configuration with a transverse aperture therein and is mounted on said support structure and movable between normal and interim positions and the other of which is movable independently of said support structure, and latch means comprising a latch element having a latching finger disposed in said aperture and engageable with a part of said other contact when disposed in said one hollow contact for preventing substantial movement of said one contact from its normal position toward its interim position.

14. Electric apparatus according to claim 13 wherein a biasing spring engages said latch element at a part thereof which is in substantial longitudinal coincidence with said latching finger.

15. Electric apparatus according to claim 13 wherein the inner end of said latching finger is bevelled in a direction axially of said one contact.

16. Electric connector apparatus comprising hollow elongated support structure, a tubular electric contact mounted within said support structure and movable longitudinally relative thereto between a normal closed circuit position and an interim position, said interim position being spaced longitudinally from said normal position, a contact pin movable independently of said support structure and engageable and disengageable with said tubular contact, magnetic means operable in coordination with the initiation of the flow of electric current through said tubular contact and said contact pin during circuit closing operations for moving said contact from its normal position toward its interim position, and latch means engageable with a part of said support structure in coordination with circuit closing movement of said contact pin for securing said tubular contact in its normal position.

17. A method of closing a pair of relatively movable electric contacts comprising the steps of moving one of said contacts toward the other of said contacts, quickly moving the other of said contacts from a normal position and toward said one contact to an interim position and into engagement therewith at a velocity of movement which is substantially solely dependent on the magnitude of current in an electric arc struck between said contacts, moving said contacts in unison until said other contact reaches its normal position, and finally latching said one contact in its normal position.

18. A method according to claim 17 wherein the other of said contacts is movable independently of said one contact irrespective of whether said one contact is disposed in its normal or interim position.

19. A method of separating a pair of closed relatively movable frictionally related electric contacts comprising the steps of imparting an opening force to one of said contacts thereby causing said one contact to move in a direction away from the other contact for a portion of its opening movement and thereafter moving said contacts in unison to cause the other of said contacts to move from a normal position to an interim position, and arresting movement of said other contact at its interim position while continuing to impart an opening force to said one contact which is sufficient to overcome the friction force tending to hold the contacts closed to separate said contacts.

* * * * *